US011969131B2

(12) United States Patent
Hong

(10) Patent No.: US 11,969,131 B2
(45) Date of Patent: Apr. 30, 2024

(54) DISHWASHER

(71) Applicant: LG Electronics Inc., Seoul (KR)

(72) Inventor: Younhee Hong, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 17/517,915

(22) Filed: Nov. 3, 2021

(65) Prior Publication Data

US 2022/0133126 A1 May 5, 2022

(30) Foreign Application Priority Data

Nov. 3, 2020 (KR) ..... 10-2020-0145283

(51) Int. Cl.
*A47L 15/50* (2006.01)

(52) U.S. Cl.
CPC ..... *A47L 15/507* (2013.01)

(58) Field of Classification Search
None
See application file for complete search history.

(56) References Cited

U.S. PATENT DOCUMENTS

| | | | |
|---|---|---|---|
| 8,746,467 | B2 | 6/2014 | Jeong |
| 2008/0156362 | A1 | 7/2008 | Shin et al. |
| 2016/0360946 | A1 | 12/2016 | Shewmaker |
| 2019/0298146 | A1 | 10/2019 | Gutkowski |

FOREIGN PATENT DOCUMENTS

| | | |
|---|---|---|
| EP | 3090677 | 11/2016 |
| EP | 3175765 | 6/2017 |
| WO | WO2017030355 | 2/2017 |

OTHER PUBLICATIONS

Extended European Search Report in European Appln. No. 21205918.2, dated Mar. 17, 2022, 10 pages.

*Primary Examiner* — Rita P Adhlakha
(74) *Attorney, Agent, or Firm* — Fish & Richardson P.C.

(57) ABSTRACT

A dishwasher includes a storage and a moving mechanism that is coupled to and decoupled from a tub and configured to move in a front-rear direction of the tub. The moving mechanism includes a pair of first rollers provided in each lateral surface of the storage and configured to guide the moving of the storage, a guide provided in each lateral surface of the storage, under the first roller, and configured to guide the moving of the storage, and a guide rib disposed between an upper end of the first roller and a lower end of the guide. The guide rib is provided in each lateral surface of the storage and protrudes in a lateral direction of the storage.

20 Claims, 10 Drawing Sheets

DISHWASHER

CROSS-REFERENCE TO RELATED APPLICATION

This application claims priority to and the benefit of Korean Patent Application No. 10-2020-0145283, filed in Korea on Nov. 3, 2020, the disclosure of which is incorporated herein by reference in its entirety.

TECHNICAL FIELD

Disclosed herein is a dishwasher, more particularly, a dishwasher including a storage.

BACKGROUND

Details in the background section do not constitute the related art but are given only as background information concerning the subject matter of the present disclosure.

Generally, a dishwasher is a device configured to wash dry the dishes placed therein by using wash water sprayed to the dishes or cooking vessels with a high pressure and dry them after that. Specifically, such a dishwasher may spray wash water into a tub, in which cooking vessels are disposed, with a high pressure and the sprayed water may contact the cooking vessels to wash off leftovers from the cooking vessels.

The dishwasher may include a filter for filtering leftovers and food scraps from the cooking vessels and recycling the used water. Also, the dishwasher may provide mixedly a washing detergent together with wash water to remove food scraps from the cooking vessels efficiently. A dishwasher further including a heater for raising the temperature of the wash water or generating steam to enhance washing performance is widely used in recent.

The dishwasher may include a tub provided as a washing space; and a storage in which cooking vessels may be selectively stored based on the types and sizes of the cooking vessels.

In this embodiment, a plurality of storages may be provided and the storages may be divided into multiple steps along a vertical direction of the washing tub.

Each of the storages may include a plurality of rollers provided in a lower area. The rollers may be guided by auxiliary guide means that are provided in the washing tub to be movable rearwards and forwards.

Meanwhile, when operating the dishwasher to wash cooking vessels, a user has to open a door of the dishwasher and pull out one of the storages provided in the tub and place some cooking vessels on the storage. After that, the user has to push back the storage into the washing tub of the dishwasher and close the door to complete the dish storing.

Accordingly, the storage needs to have a configuration that makes it smooth and easy for users to couple and decouple the storage to and from the tub.

European Patent No. EP3175765B1 discloses a structure of a drawer detachable from a dishwasher. European Patent No. EP3090677B1 discloses a structure of a drawer used in a dishwasher. In addition, U.S. Pat. No. 8,746,467B2 discloses a structure of a dishwasher including a basket unit.

Meanwhile, the storage needs to be configured not to have a disadvantage of breakage, which might occur when the storage moving in the tub shakes too much to collide against other elements provided in the tub.

Typically, the conventional storage is likely to shake within a certain range along a left-and-right direction when moving a back-and-forth direction with respect to the tub. Accordingly, the storage needs to have a structure for suppressing the shaking and the above-mentioned cited references may not disclose any structures or solutions to such a disadvantage. There are demands for the solution to the disadvantage.

SUMMARY

Technical Problems

Accordingly, an object of the present disclosure is to address the above-noted and other problems and to provide a storage of a dishwasher that has a structure for smoothly coupling and detaching a storage to and from a tub.

A further object of the present disclosure is to provide a storage configured to suppress the collision against a tub, when moving along a back and force direction in the tub.

A still further object of the present disclosure is to provide a dishwasher including the above-mentioned storage and improved durability.

Aspects according to the present disclosure are not limited to the above ones, and other aspects and advantages that are not mentioned above can be clearly understood from the following description and can be more clearly understood from the embodiments set forth herein. Additionally, the aspects and advantages in the present disclosure can be realized via means and combinations thereof that are described in the appended claims.

Technical Solutions

Embodiments of the preset disclosure may provide a dishwasher including a storage. The storage according to one embodiment may include a moving mechanism smoothly coupled to and decoupled from a tub and configured to move in a front-rear direction of the tub.

The moving mechanism may include a pair of first rollers provided in each lateral surface of the storage and configured to guide the moving of the storage; a guide provided in each lateral surface of the storage, under the first roller, and configured to guide the moving of the storage; and a guide rib disposed between an upper end of the first roller and a lower end of the guide, the guide rib provided in each lateral surface of the storage and protruded in a lateral direction of the storage.

The tub may include a guide mechanism provided in each inner lateral wall of the tub and configured to accommodate the storage and guide the moving of the storage.

The guide mechanism may include a guide rail having an upper end configured to contact with the first roller and a lower end configured to contact with the guide, the guide rail to which the storage is coupled, with a longitudinal length arranged in a front-rear direction of the tub; and a rail supporter a rail supporter coupled to each lateral wall of the tub, the rail supporter to which the guide rail is secured.

The guide may include a second roller configured to support a lower end of the guide rail; and a rail guide spaced a preset distance from the second roller in a front-rear direction of the storage and protruded in a lateral direction of the storage.

The rail supporter may include a plurality of first pieces spaced a preset distance from each other in a front-rear direction of the tub, the plurality of the first pieces to which the guide rail is secured; a second piece having one end coupled to a lateral wall of the tub and the other end coupled to the first piece; and a third piece of which the longitudinal direction is arranged in the front-rear direction of the tub, and in which the second piece is inserted.

At least predetermined area of the guide rib may face the guide rail.

A pair of guide ribs may be provided in one lateral surface of the storage and the pair of the guide ribs are spaced a preset distance from each other in a front-rear direction and a vertical direction of the storage.

One of the two guide ribs may be arranged in front of the first roller and the rail guide, and the other one is arranged behind the first roller and the second roller.

The storage may further include a mount bracket mounted to a lateral surface of the storage, and the mount bracket to which the first roller and the second roller are mounted.

The mount bracket may include a first mounting portion protruded from one side and configured to be inserted in a first mounting hole formed in the lateral surface of the storage; a second mounting portion protruded from the other side and configured to be inserted in a second mounting hole formed in the lateral surface of the storage spaced apart from the first mounting hole; and an avoid groove provided in a corresponding shape to the rail guide and formed by recessing a predetermined area of the mount bracket to avoid the rail guide when the mount bracket is coupled to the storage.

One of the guide ribs may be formed in front of the mount bracket, spaced a preset distance apart from the mount bracket, and the other one is formed behind the mount bracket, spaced a preset distance apart from the mount bracket.

One embodiment of the present disclosure may further provide a dishwasher including a tub a tub in which cooking vessels are placed; a first storage provided in the tub and configured to hold cooking vessels; a second storage provided in the tub and arranged above the first storage, and configured to hold cooking vessels; and a third storage provided in the tub and above the second storage, and configured to hold cooking vessels wherein the storage comprises, The third storage may include a pair of first rollers provided in each lateral surface of the storage and configured to guide the moving of the storage; a guide provided in each lateral surface of the storage, under the first roller, and configured to guide the moving of the storage; and a guide rib disposed between an upper end of the first roller and a lower end of the guide, the guide rib provided in each lateral surface of the storage and protruded in a lateral direction of the storage.

The dishwasher may further include a guide rail having an upper end configured to contact with the first roller and a lower end configured to contact with the guide, the guide rail to which the storage is coupled, with a longitudinal length arranged in a front-rear direction of the tub.

The guide rib may have a round end and a round corner. The length of the guide rib in a front-rear direction of the storage may be larger than the length of the guide rib in a vertical direction of the storage.

Advantageous Effects

The storage according to the embodiments of the present disclosure may include the first roller, the second roller and the rail guide that are provided in both lateral surfaces. Those elements may allow the storage to be coupled to the guide rail provided in the tub smoothly. Accordingly, the storage may be moved along the guide rail in the front-rear direction of the tub smoothly.

The storage according to the embodiments of the present disclosure may include the guide rib provided in the each lateral surface. If too much left-right tilt of the storage occurs, the guide rib may contact with the guide rail and limit the range of the left-right tilt. Accordingly, the guide rib may prevent at least one of the first roller, the second roller or the rail guide provided in the storage from being collided against a packing provided in a front area of the tub by the left-right tilt of the storage.

In addition, the guide rib provided in the storage according to the embodiments of the present disclosure may suppress the collision between the storage and the packing such. Accordingly, the damage of the packing caused by the collision with the storage and the error of the dishwasher caused by the collision may be effectively suppressed.

Further scope of applicability of the present invention will become apparent from the detailed description given hereinafter. However, it should be understood that the detailed description and specific examples, while indicating preferred embodiments of the invention, are given by illustration only, since various changes and modifications within the spirit and scope of the invention will become apparent to those skilled in the art from this detailed description.

BRIEF DESCRIPTION OF DRAWINGS

The accompanying drawings constitute a part of the specification, illustrate one or more embodiments in the disclosure, and together with the specification, explain the disclosure, wherein.

DETAILED DESCRIPTION

Figure 1:
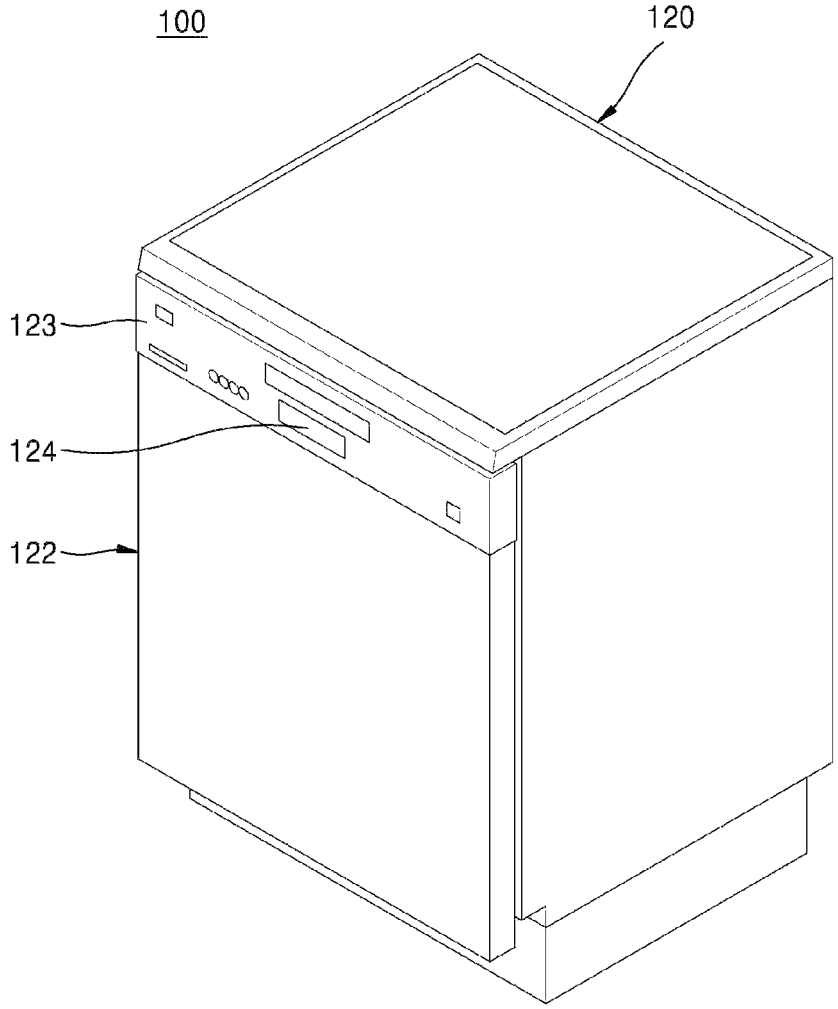
FIG. 1 is a perspective diagram illustrating a dishwasher according to one embodiment of the present disclosure.

The above-described aspects, features and advantages are specifically described hereunder with reference to the accompanying drawings such that one having ordinary skill in the art to which the present disclosure pertains can easily implement the technical spirit of the disclosure. In the disclosure, detailed descriptions of known technologies in relation to the disclosure are omitted if they are deemed to make the gist of the disclosure unnecessarily vague. Below, preferred embodiments according to the disclosure are specifically described with reference to the accompanying drawings. In the drawings, identical reference numerals can denote identical or similar components.

The terms “first”, “second” and the like are used herein only to distinguish one component from another component.

Thus, the components should not be limited by the terms. Certainly, a first component can be a second component unless stated to the contrary.

Throughout the disclosure, each component can be provided as a single one or a plurality of ones, unless explicitly stated to the contrary.

The singular forms "a", "an" and "the" are intended to include the plural forms as well, unless explicitly indicated otherwise. It should be further understood that the terms "comprise" or "include" and the like, set forth herein, are not interpreted as necessarily including all the stated components or steps but can be interpreted as excluding some of the stated components or steps or can be interpreted as including additional components or steps.

Throughout the disclosure, the terms "A and/or B" as used herein can denote A, B or A and B, and the terms "C to D" can denote C or greater and D or less, unless stated to the contrary.

The terms "vertical direction" as used herein can denote a vertical direction of a dishwasher that is typically installed to be used. The term "left and right direction" can denote a direction that is orthogonal to the vertical direction, and the terms "back and force direction" can denote a direction that is orthogonal to both the vertical direction and the left and right direction. The terms "both directions or bidirectional" or "side direction or lateral" can denote the same direction with the left and right direction. Such the terms can be mixed through the disclosure.

Figure 2:
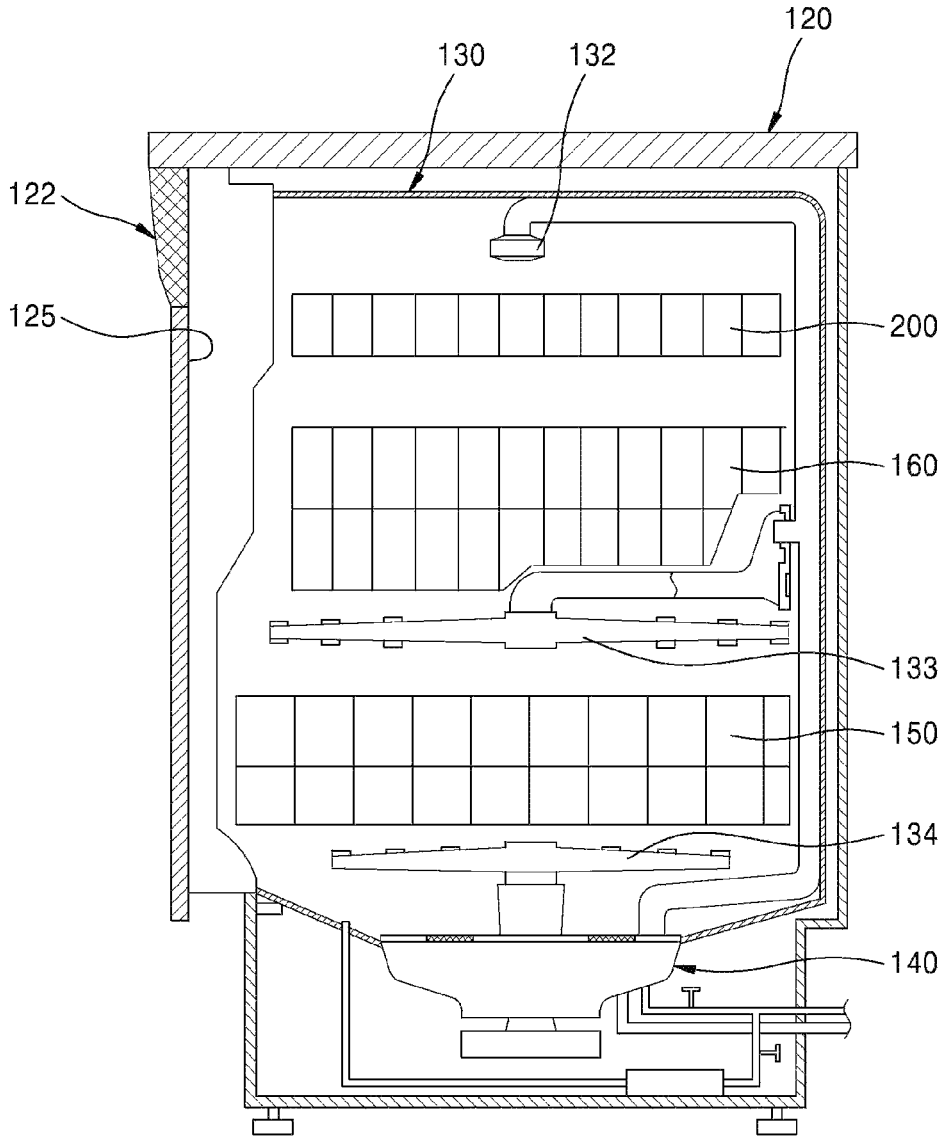
FIG. 2 is a sectional diagram schematically illustrating the dishwasher according to one embodiment.

FIG. 1 is a perspective diagram illustrating a dishwasher 100 according to one embodiment of the present disclosure. FIG. 2 is a sectional diagram schematically illustrating the dishwasher 100 according to one embodiment.

As shown in FIGS. 1 and 2, the dishwasher according to this embodiment may include a case 120 that defines an exterior of the dishwasher; and a tub 130 disposed in the case 120 and defining a washing space for washing cooking vessels, with an open front side.

In addition, the dishwasher 100 may include a door 122 provided to open and close the open front of the tub 130; and a drive 140 provided under the washing tub 130 and configured to supply, collect, circulate and drain the wash water for washing dishes.

In addition, the dishwasher 100 may include a plurality of storages 150, 160 and 200 detachably provided in the tub 130 to have cooking vessels placed thereon; and a plurality of spraying parts 132, 133 and 134 installed adjacent to the storages 150, 160, 200, respectively, and configured to wash them. In this instance, the storages 150, 160 and 200 may be provided in the dishwasher and receive dishes thereon.

In the dishwasher 100, the structures of the washing tub 130, the drive 140 and the spray portions may be identical to conventional structures or realized by similar structures. Accordingly, detailed descriptions of such the structures are omitted.

Meanwhile, the plurality of the storages 150, 160 and 200 may be movable from the inside of the washing tub 130 to an open side of the tub 130. The storages 150, 160 and 200 may include a first storage 150 provided in a lower area of the tub 130 and configured to have relatively large cooking vessels placed thereon; a second storage 160 provided above the first storage 150 and configured to have relatively small cooking vessels placed thereon; and a third storage 200 provided in an upper area of the tub 130 and configured to have not only cooking vessels but also other tableware placed thereon.

The plurality of the spray portions 132, 133 and 134 may be provided to spray wash water to the cooking vessels placed in the storages 150, 160, 200. Such the spray portions 132, 133 and 134 may include a lower spray portion 134 provided in the lower area of the tub 130; an upper spray portion 133 provided between the first storage 150 and the second storage 160 to spray wash water to the first and second storages 150 and 160; and a top spray portion 132 provided in the upper area of the tub to spray wash water to the third storage 200 or the second storage 160.

At this time, the top spray portion 132 may not be a necessary element of the dishwasher 100. According to embodiments, it may not be provided.

Meanwhile, a guide may be provided in both lateral walls of the tub 130 to guide the withdrawing of the first, second and third storages 150, 160 and 200. A guide mechanism 1310 for guiding such the moving of the third storage 200 may be described in detail as follows, referring to the accompanying drawings.

Meanwhile, door 122 may be configured to open and close the open side formed in a front surface of the above-mentioned tub 130. Typically, such the door 122 may include a hinge provided in a lower portion of the open front and configured to open and close the door 122. The door 122 may be open on the hinge as a rotating shaft.

An outer surface of the door 122 may be provided with a handle 124 for opening the door 122 and a control panel 123 for controlling the washing machine 100. An inner surface of the door 122 may have a disposing surface that defines one surface of the tub 130 when the door 122 is closed and has the first storage 150 disposed therein when the door 122 is open.

For that, the disposing surface of the door 122 may form a horizontal surface extending from the guide for guiding the first storage 150.

Hereinafter, the structure of the storage according to the embodiment and related structures may be described in reference to the third storage 200 as one example. The structures of the first and second storages 150 and 160, and related structures may have similar to the structure of the third storage 200 which will be described later.

Accordingly, the conventional configuration of the dishwasher 100 and the first and second storages 150 and 160 are omitted. Referring to the accompanying drawings, the structure of the third storage 200 and the related structures will be described as follows.

Figure 3:
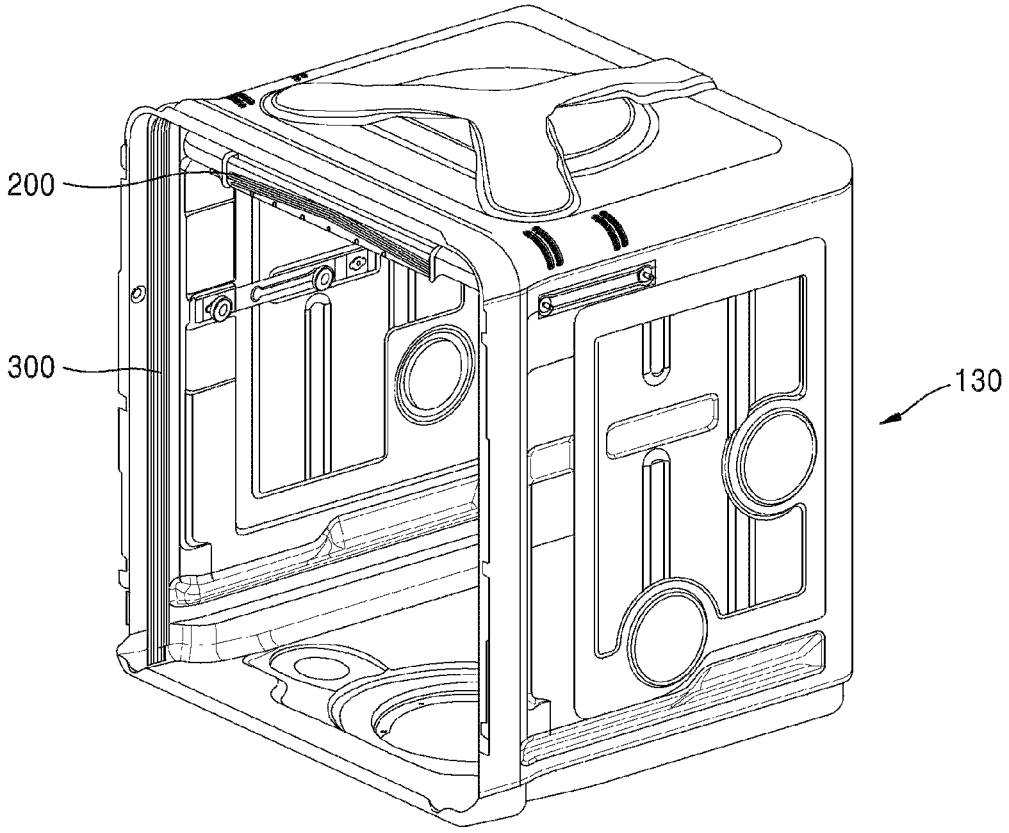
FIG. 3 is a perspective diagram illustrating an inside of the dishwasher according to one embodiment.
Figure 4:
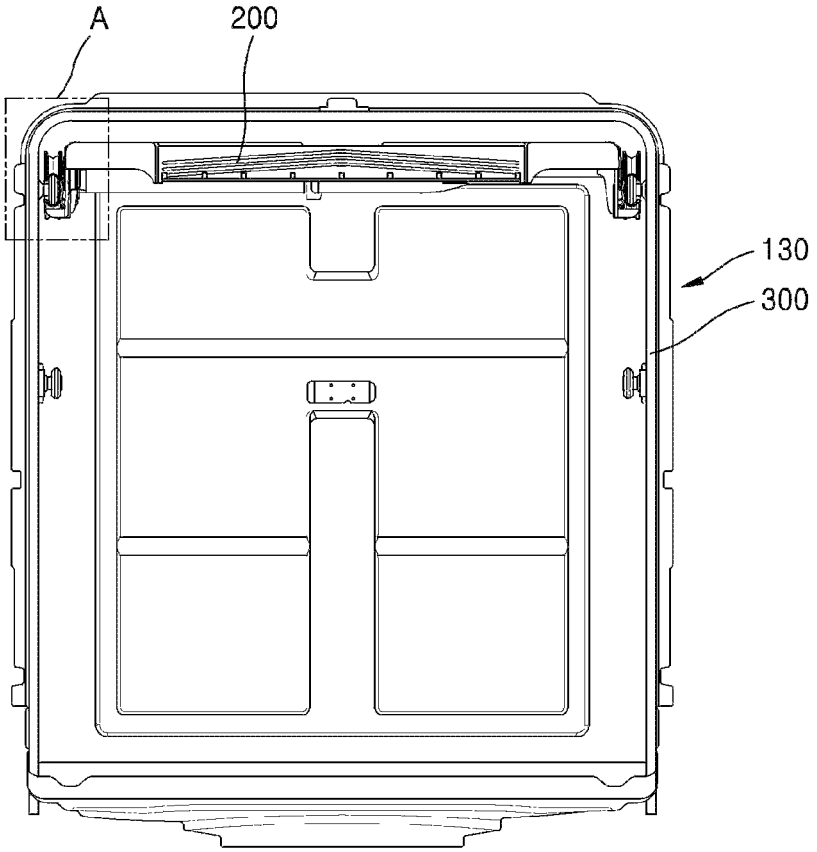
FIG. 4 is a front view of FIG. 3.
Figure 5:
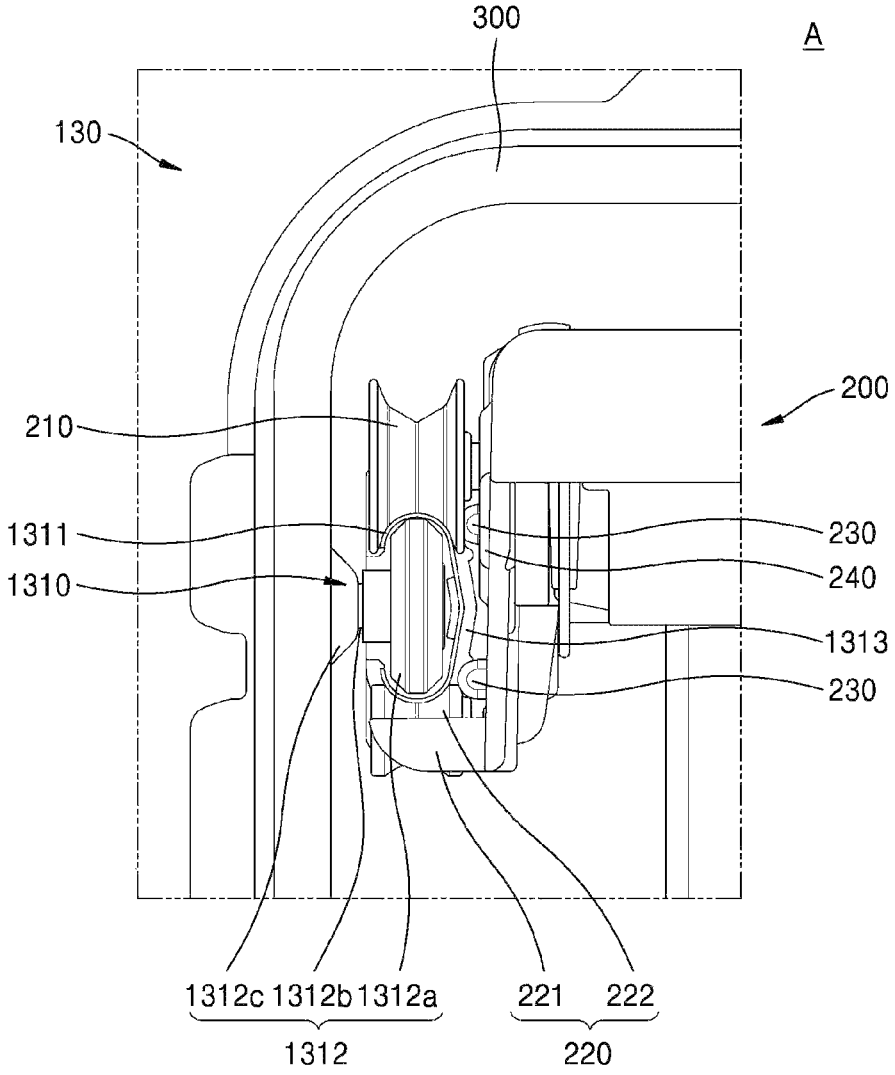
FIG. 5 is an enlarged view of A shown in FIG. 4.

FIG. 3 is a perspective diagram illustrating the inside of the dishwasher according to one embodiment. FIG. 4 is a front view of FIG. 3. FIG. 5 is an enlarged view of "A" shown in FIG. 4.

A packing 300 may be coupled to a front portion of the open front. The packing 300 may contact with an edge portion of the door 122 when the door 122 is closed and seal the tub 130. Accordingly, the packing 300 may prevent wash water and other foreign materials from leaking through a gap formed between the door 122 and the tub 130 outside the dishwasher 100. For example, the packing 300 may be made of a predetermined material with high sealing performance (e.g., rubber and silicon).

As shown in FIGS. 3 and 4, the packing 300 may be arranged in the edge portion of the open front, except a bottom area of the tub 130. The packing 300 may be integrally formed of a flexible material as one body. When coupled to the tub 130, the packing 300 may have a reversed "U" shape.

Meanwhile, the third storage 200 may be detachably provided in the tub 130. For that, guide rail 1311 which will be described later may be provided in both lateral walls inside the tub 130.

The longitudinal direction of the guide rail 1311 may be arranged along forward and backward with respect to the tub 130 such that the user may couple or decouple the third storage 200 to or from the tub 130. At this time, the third storage 200 may move forward and backward with respect to the tub 130 along the longitudinal direction of the guide rail 1311.

However, some tilt that means the reciprocating of the third storage 200 along leftward and rightward in the tub 130 might occur when the third storage 200 is moving forward and backward with respect to the tub 130. The leftward and rightward tilt may be referred to left-right moving.

The left-right moving of the third storage 200 means that the third storage 200 is tilted within a certain range along a left-right direction 130 that is perpendicular to a front-rear direction of the tub 130, as shown in FIG. 4.

Such the left-right moving is likely to cause the collision of the third storage 200 against the other components provided in the tub 130, when the third storage 200 is coupled to or decoupled from the tub 130.

Especially, referring to FIG. 5, both sides of the third storage 200 may be provided with a first roller 210, a second roller 221 and a rail guide 222 that are supported by the guide rail 1311 secured to the tub 130.

If too much left-right moving occurs while the third storage 200 is moved forward and backward to be coupled to or decoupled from the tub 130, at least one of the first roller 210, the second roller 221 or the rail guide 222 may be collided against the packing 300 arranged in front of the.

If the collision of the first roller 210, the second roller 221 or the rail guide 222 against the packing repeatedly occurs, the packing 300 might be broken or separated from the tub 130 and cause the breakage, shortened lifespan and performance deterioration of the dishwasher.

Accordingly, the left-right moving or tilt of the third storage 200 needs to be suppressed or the range of the left-right moving needs to be limited such that the collision of the first roller 210, the second roller 221 or the rail guide 221 may be suppressed.

In some implementation, a structure is suggested that is configured to prevent the left-right moving of the third storage 200 or at least limit the range of the left-right moving when the third storage 200 is moving forward and backward in the tub 130.

Figure 6:
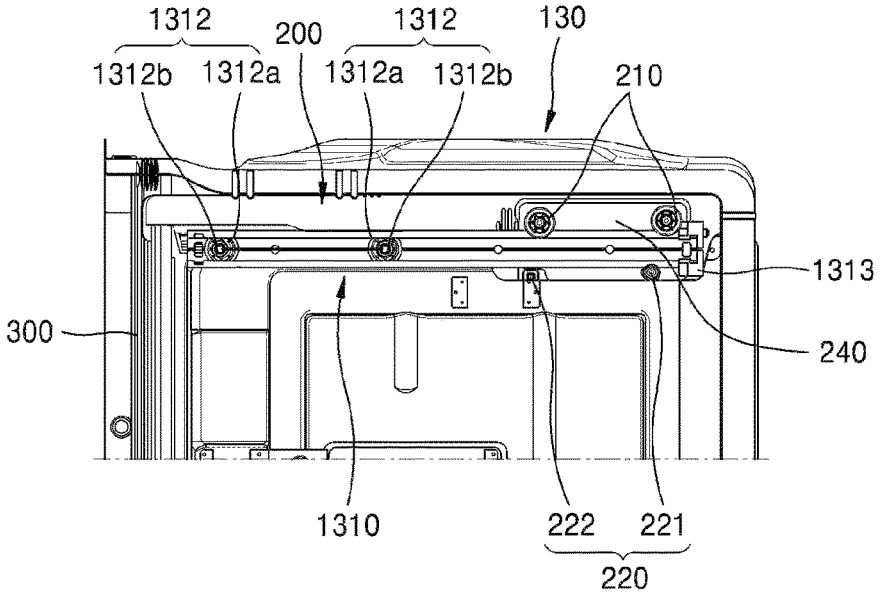
FIG. 6 is a side sectional view partially illustrating the inside of the dishwasher according to one embodiment.
Figure 7:
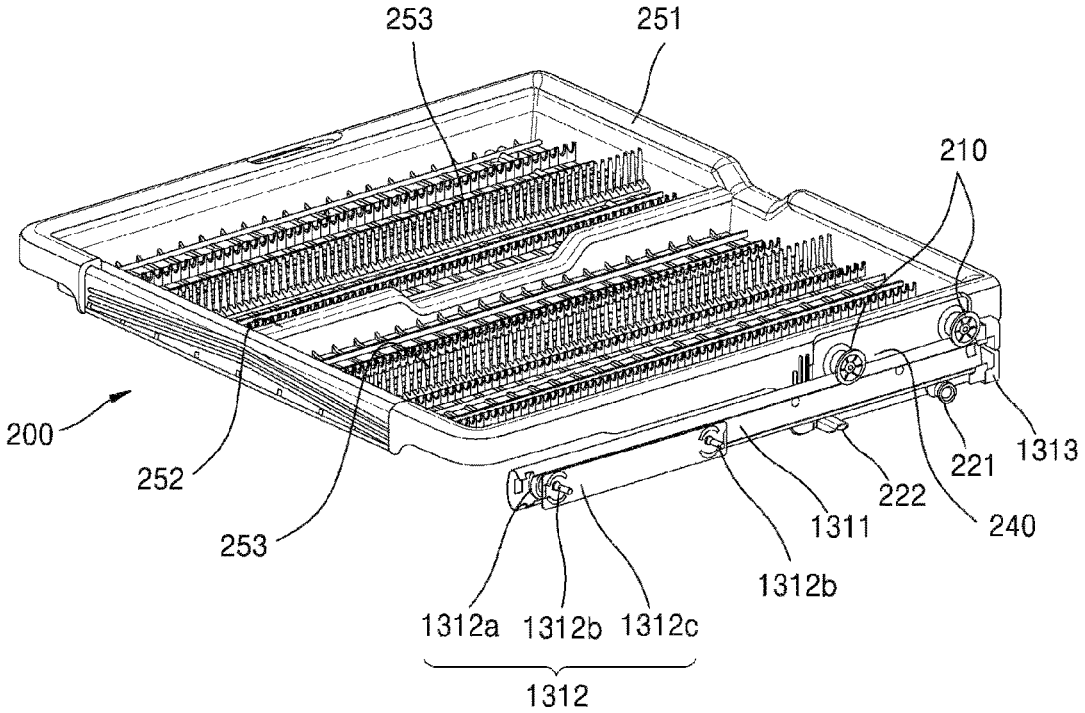
FIG. 7 is a perspective diagram to describe a structure of a third storage according to one embodiment.
Figure 8:
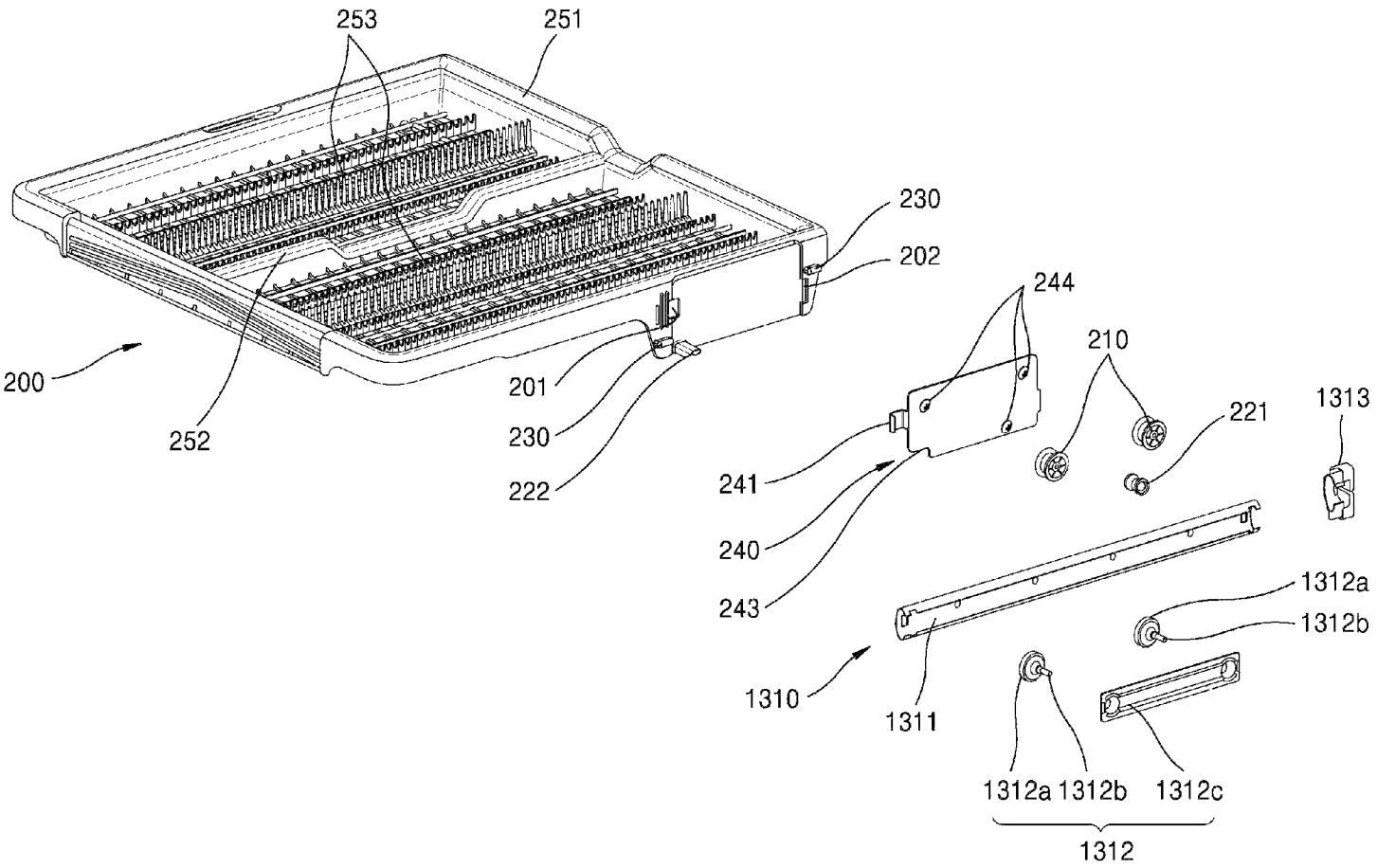
FIG. 8 is an exploded perspective diagram of FIG. 7.
Figure 9:
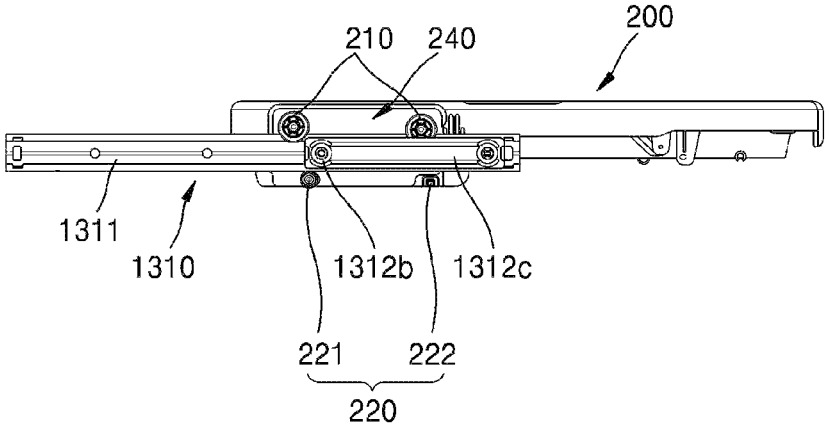
FIG. 9 is a side view to describe the structure of the third storage according to one embodiment.

FIG. 6 is a side sectional view partially showing the inside of the dishwasher 100 according to one embodiment. FIG. 7 is a perspective view to describe a structure of a third storage 200 according to one embodiment. FIG. 8 is an exploded perspective view of FIG. 7. FIG. 9 is a side view to describe the structure of the third storage 200 according to one embodiment.

As it is provided in the tub 130 in which wash water is repeated sprayed, it may be proper that the third storage 200 is made of a material with excellent corrosion resistance. Also, the third storage 200 may be made of light material to allow the user to move it smoothly. Accordingly, the third storage 200 may include a polymer or plastic material as one example but the embodiments of the present disclosure are not limited thereto.

Referring to FIG. 7, the third storage 200 may include an outer frame 251, a divide frame 252 and a storage portion 253.

The outer frame 251 may define an exterior of the third storage 200. In this instance, the outer frame 251 may be provided in an approximately square shape, viewed in a vertical direction.

The divide frame 252 may have both ends that are connected to the outer frame 251 and provided to cross a center of the third storage 200. The divide frame 252 may divide the third storage 200 into multiple areas.

FIG. 7 shows that one divide frame 252 is provided in the third storage 200 and configured to divide the entire area of the third storage 200 into two areas. However, the present disclosure may not be limited thereto and the third storage 200 may be divided into three or more areas based on the number or layout shape of the divide frame 252.

The storage portion 253 may be provided in an area surrounded by the outer frame 251 and the divide frame 252. Various structures for storing cooking vessels may be applied to the storage portion 253.

For example, the storage portion 253 may have recessed areas and protruded areas to hold plates, bowls, spoons, chop sticks or the like. Such recessed and protruded areas may be formed in various shapes.

In addition, the storage portion 253 may be configured in a mesh structure such that the sprayed wash water can flow through the storage portion. To have the recessed and protruded areas, the storage portion 253 may be configured of the multiple wires structured to cross each other.

Referring to FIGS. 5, 6, and 7, the third storage 200 may include a first roller 210, a guide 220 and a guide rib 230. The first roller 210, the guide 220 and the guide rib 230 may be provided in each of the lateral surfaces formed in the third storage 200.

In this instance, they may be provided in each lateral surface so as to be symmetrical to each other based on the center line with the same number. For example, two first rollers 210 may be provided in each lateral surface of the third storage 200 in the dishwasher shown in the drawings and a total of four first rollers 210 may be provided.

A pair of first rollers 210 may be provided in the lateral surfaces of the third storage 200, respectively, and configured to guide the moving of the third storage 200. The first rollers 210 may be rotatable in the lateral surfaces of the third storage 200.

When the third storage 200 is coupled to the tub 130, the first roller 210 may be supported by an upper end of the guide rail 1311. Accordingly, the guide rail 1311 may move in the front-rear direction of the tub 130 and the first roller 210 may then rotate in contact with the upper end of the guide rail 1311.

As shown in FIG. 5, a diameter of the first roller 210 may decrease more and more towards a center from an edge, viewed in the width direction, such that it may have a shape that is concave with respect to the guide rail 1311.

At this time, the guide rail 1311 may have a shape that is convex with respect to the first roller 210. With such a shape and configuration, the first roller 210 may be stably secured to the guide rail 1311 not to separate there from.

As shown in FIG. 6, the pair of the rollers 210 may be disposed to have the same or similar height along a vertical direction of the third storage 200. That is for the guide rail 1311 to support the first roller uniformly.

The pair of the roller 210 may be spaced a preset distance from each other in a longitudinal direction of the third storage 200. A proper distance between the first rollers 210 may be selected in consideration that the third storage 200 should not separate from the guide rail 1311 easily and that too much tilt of the third storage 200 should not occur in the vertical direction when the third storage 200 moves along the guide rail 1311.

The guide 220 may be provided in each lateral surface of the third storage 200, under the first roller 210, and configured to guide the moving of the third storage 200. When the third storage 200 is coupled to the tub 130, the guide rail 1311 coupled to each lateral wall of the tub 130 may be secured between the first roller 210 and the guide 220 such that the third storage 200 may move along the longitudinal direction of the guide rail 1311.

The guide 220 may include a second roller 221 and a rail guide 222. The second roller 221 and the rail guide 222 may be spaced a preset distance apart from each other along the longitudinal direction of the third storage 200.

The second roller 221 and the rail guide 222 may be distant from each other in the longitudinal direction of the third storage 200. The distance between the second roller 221 and the rail guide 222 may be properly selected, considering that the third storage 200 should not separate from the guide rail 1311 easily and that too much tilt of the third storage 200 should not occur in the vertical direction when the third storage 200 moves along the guide rail 1311.

The second roller 221 may be supported by a lower end of the guide rail 1311. The second roller 221 may be rotatably provided in each lateral surface of the third storage 200. The second roller 221 may be disposed under the first roller, spaced a predetermined distance from the first roller 210.

The guide rail 1311 may be disposed in the space formed between the first roller 210 and the second roller 221 spaced apart in the vertical direction. When the third storage 200 moves along the front-rear direction of the tub 130, the first roller 210 or the second roller 221 may rolling-contact with the guide rail 1311.

At this time, with the load of the third storage 200 and the cooking vessels placed therein, the pair of the first rollers 210 disposed in an upper portion of the guide rail 1311 may rolling-contact with the guide rail 1311 to support the moving of the third storage 200. The first roller 210 arranged under the guide rail 1311 may auxiliary rolling-contact with the guide rail 1311 and support the moving of the third storage 200.

Referring to FIG. 5, a diameter of the second roller 221 may decrease more and more to the center from an edge, viewed in the width direction, such that the second roller 221 may have a shape that is upwardly concave with respect to the guide rail 1311.

At this time, the guide rail 1311 may have a shape that is downwardly convex with respect to the second roller 221. Due to the structure, the second roller 221 may be stably secured to the guide rail 1311 not to separate there from.

The rail guide 222 may be provided distant from the second roller 221 in the front-rear direction of the storage in a shape that is protruded in a lateral direction of the storage. In this instance, the rail guide 222 may be integrally formed with the third storage and the embodiment is not limited thereto.

The rail guide 222 may auxiliarily support and guide the moving of the third storage 200 with respect to the guide rail 1311, together with the second roller 221. Especially, the rail guide 222 may be configured to suppress the too much tilt of the tub 130 in the vertical direction, when the third storage 200 moves.

Referring to FIG. 9, when the third storage 200 is coupled to the third storage 200, the guide rail 1311 may be provided such that an upper end of the rail guide 222 and a lower end of the guide rail 1311 may be spaced a preset distance apart from each other in the vertical direction of the tub 130.

Accordingly, if the third storage 200 is tilted in the vertical direction of the tub 130 too much during the moving of the third storage 200 along the front-rear direction of the tub 130, the guide rail 1311 and the rail guide 222 may sliding-contact with each other and the vertical tilt of the third storage 200 may be limited within a designed range.

As the upper of the rail guide 222 is spaced apart from the lower end of the guide rail 1311 in the vertical direction of the tub 130, the rail guide 222 and the guide rail 1311 may not always contact each other.

Specifically, in case the third storage 200 is tilted in the vertical direction of the tub 130 too much, the rail guide 222 and the guide rail 1311 may sliding-contact with each other so as to limit the tilting range of the third storage 200.

Due to such the structure, may intermittently contact with each other such that the wear, noise likely to be generated by the frequent contact between the rail guide 222 and the guide rail 1311 may be effectively suppressed.

As another example of the guide 220, a pair of second rollers 221 may be spaced apart from each other in the front-rear direction of the third storage 200. Referring to FIG. 9, the second rollers 221 may be provided in the position instead of the rail guide 222.

At this time, the pair of the second roller 221 may rolling-contact with the guide rail 1311 to support a front-rear direction area of the third storage 200 with respect to the tub 130 stably.

It may be determined based on the size, structure and production cost of the third storage 200 whether the guide 220 may be configured of both the second roller 221 and the rail guide 222 or the pair of the second rollers 221. Even if the configuration of the guide 220 is changed as mentioned above, the structure of the guide rail 1311 may not be changed.

Hereinafter, referring to FIGS. 5 through 9, the elements provided in the tub 130 and the third storage 200 will be described in detail.

The tub 130 may include a guide mechanism provided in each lateral wall of the tub 130 and configured to guide the moving of the coupled storage. Hereinafter, a guide mechanism 1310 related with the third storage 200 will be described as one example.

A pair of guide mechanisms 1310 may be provided. Each of them may be fixedly secured to both lateral walls. The guide mechanism 1310 may include a guide rail 1311 and a rail supporter 1312.

The guide rail 1311 may have a lower end that is in contact with the first roller to be supported and a lower end that is in contact with the guide 210 to be supported. The storage may be disposed in the guide rail 1311 and a longitudinal direction of the guide rail 1311 may be arranged in the front-rear direction of the tub 130.

A plurality of guide rails 1311 may be provided and each of the guide rails 1311 may be coupled to each lateral wall of the tub 130. Accordingly, the pair of the guide rails 1311 may support the both sides of the third storage 200, respectively, as one example.

The guide rail 1311 may be relatively thin and have a convex shape towards the third storage 200. The shape of the guide rail 1311 may be concave towards the lateral wall and the rail supporter 1312 may be disposed in the concave portion.

The guide rail 1311 may be made of aluminum or a metal having including aluminum with strongly resistance corrosion against wash water. When the guide rail 1311 is formed of such a metal, a plate-shaped material may bend in the width direction and the exterior of the guide rail 1311 may be formed accordingly.

As another example, the guide rail 1311 may be made of a non-metal material (e.g., polymer and plastic) with a strong corrosion resistance against wash water. For example, in case the guide rail 1311 is formed of such metal, the metal may be injection-molded and the exterior of the guide rail 1311 may be formed.

As mentioned above, the guide rail 1311 may have the upper end supporting the pair of the first roller 210 and the lower end supporting the second roller 221 and the rail guide 222.

The rail supporter 1312 may be secured to each lateral wall of the tub 130 and the guide rail 1311 may be coupled to the rail supporter. A pair of rail supporters 1312 may be provided and each of the rail supporters may be fixedly secured to the tub 130.

Referring to FIGS. 5 and 7, the rail supporter 1312 may include a first piece 1312*a*, a second piece 1312*b*, and a third piece 1312*c*.

The first piece 1312*a* may be configured of plurality of pieces that are spaced apart from each other in the front-rear direction of the tub 130 and the guide rail 1311 may be secured to the first pieces. Referring to FIG. 6, two first pieces 1312*a* may be provided in the embodiment and the embodiment is not limited thereto. Three or more first pieces may be provided.

The first piece 1312*a* may be formed in a circular shape, and include a large diameter portion that is larger than a diameter and a small diameter portion that is smaller than a diameter. For example, the first piece 1312*a* include one or more disks.

The guide rail 1311 may be secured to the large diameter portion. A predetermined space may be provided between the third piece 1312*c* and the large diameter portion such that the first roller 210, the second roller 221 and the rail guide 222 secured to the guide rail 1311 may be distant from the side wall of the tub 130.

Due to the structure, the first roller 210, the second roller 221 and the rail guide 222 may be movable in the front-rear direction of the tub 130 smoothly, without contact with the side wall of the tub 130.

One end of the second piece 1312*b* may be coupled to the side wall of the tub 130 and the other end may be coupled to the first piece 1312. The second piece 1312*b* may be secured to the lateral wall of the tub 130, passing through the first piece 1312*a* and the third piece 1312*c*. A plurality of second pieces 1312*b* and a plurality of first pieces may be provided in the same number.

To secure the second piece 1312*b* to the lateral wall of the tub 130, a through-hole may be provided in a predetermined area of the first piece 1312*a* and the second piece 1312*b*. For example, the second piece 1312*b* may be fastened to the lateral wall of the tub 130 by using a screw. Accordingly, the second piece 1312*b* may be configured of a securing piece (e.g., a screw bolt). In some examples, the second piece 1312*b* may include a rod or a protrusion that has a thread defined at an outer circumferential surface thereof.

The longitudinal direction of the third piece 1312*c* may be arranged in the front-rear direction of the tub 130. The second piece 1312*b* may be inserted in the third piece 1312*c*. Referring to FIGS. 5 and 7, there may be provided a convex portion that is protruded in a direction facing the lateral surface of the third storage 200 may be formed in an area where the second piece 1312*b* is secured via the through-hole formed in the third piece 1312*c*. In some examples, the third piece 1312*c* may include a rectangular plate or a strip.

The convex portion may provide a predetermined space between the lateral wall of the tub 130 and the first piece 1312*a*. Together with the small diameter portion of the first piece, the convex portion may allow the first roller 210, the second roller 221 and the rail guide 222 to be spaced apart from the lateral wall of the tub 130.

Accordingly, due to the small diameter portion of the first piece 1312*a* and the convex portion of the third piece 1312*c*, the first roller 210, the second roller 220 and the rail guide 222 can move in the front-rear direction of the tub 130, without contact with the lateral wall of the tub 130.

The guide mechanism 1310 may further include a stopper 1313. The stopper 1313 may be coupled to one end of the guide rail 1311 and configured to limit the moving range of the storage, specifically, the moving of the third storage 200 along the front-rear direction of the guide rail 1311.

The stopper 1313 may be coupled to a rear end of the guide mechanism 1310. The stopper may be coupled to a rear end of the guide rail 1311.

Accordingly, the first roller 210 or the second roller 221 that is provided in a rear area of the third storage 200 may be blocked by the stopper 1313 such that the third storage 200 may not be moved farther towards a rear area of the tub 130. The stopper 1313 may be forcibly coupled or fitted to the guide rail 1311. For example, the stopper 1313 may include a cap, a cover, a wall, a recess, a protrusion, or the like that can cover an end of the guide rail 1311 to thereby movement of the first roller 210 or the second roller 221.

Figure 10:
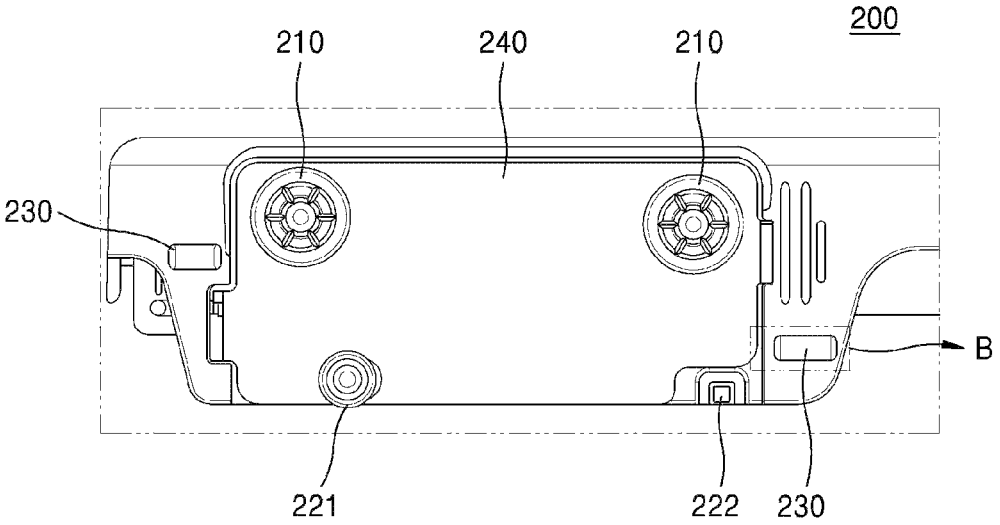
FIG. 10 is a partially enlarged view of FIG. 9.

FIG. 10 is a partially enlarged view of FIG. 9. Referring to FIGS. 8 and 10, the rail guide 222 may be integrally formed with the third storage 200. The third storage 200 may further include a mount bracket 240. The mount bracket 240 may be secured to the lateral surface of the storage such that the first roller 210 and the second roller 221 may be mounted to the mount bracket 240.

At this time, a shaft provided in each of the first and second rollers 21- and 221 may be coupled to both lateral surfaces of the third storage 200 through the mount bracket 240. Here, the first roller 210 and the second roller 221 may be assembled to rotate on its own shaft.

The mount bracket 240 may function to partially support the shafts of the first and second rollers 210 and 221 for the shafts to be mounted to the third storage 200 stably.

At this time, the shape of the mount bracket 240 may be configured to avoid the rail guide 222. That is, the mount bracket 240 may coupled to the lateral surface of the third storage 200, with avoiding the rail guide 222. A mounting surface may be formed in the lateral surface of the third storage 200 to allow the mount bracket 240 mounted therein. The mounting surface area may be larger than the mount bracket 240. A mounting groove 223 may be formed in the mounting surface and the mount bracket 240 may be mounted in the mounting groove 223.

The mount bracket 240 may be formed of a predetermined metal including aluminum, stainless or alloy of the mentioned materials with strong corrosion resistance against wash water or a non-metal material including polymer or plastic.

Here, a pair of mount bracket 240 may be provided and mounted to both lateral surfaces of the third storage 200, respectively. The mount bracket 240 may include a first mounting portion 241, a second mounting portion 242 and an avoiding groove 243.

The first mounting portion 241 may be projected from a predetermined area of the mount bracket 240 and configured to be fitted in a first mounting hole 201 formed in the lateral surface of the third storage 200. The second mounting portion 242 may be projected from the other area of the mount bracket 240 and configured to be fitted in a second mounting hole 202 formed in the lateral surface of the storage, distant from the first mounting hole 201.

The first mounting hole 201 and the second mounting hole 202 may be formed in the lateral surface of the third storage 200 and an edge area of the mounting groove, respectively. The first mounting portion 241 and the second mounting portion 242 may be forcibly inserted in or fitted in the first mounting hole 201 and the second mounting hole 202, respectively.

The avoiding groove 243 may be corresponding to the rail guide 222. When the mount bracket 240 is mounted to the storage, a predetermined area of the mount bracket 240 may be recessed as the avoid groove 243 for avoiding the rail guide 222.

The avoid groove 243 may be configured for the mount bracket 240 to be mounted to the lateral surface of the third storage 200, avoiding the rail guide 222 protruded nearby.

The mount bracket 240 may include a through-hole 244 through which the shafts of the first and second rollers 210 and 221 pass. The third storage 200 according to the embodiment may include two first rollers 210 and one second roller 221 such that the total three through-holes may be provided.

The third storage 200 may further include a guide rib 230. The guide rib 230 may be provided vertically at a level between the vertical level of an upper end of the first roller 210 and the vertical level of a lower end of the guide 220. The guide rib may be provided in each lateral surface of the third storage 200 and protruded in a lateral direction of the storage.

The guide rib 230 may be protruded from each lateral surface of the third storage 200 and configured to limit the range of the left-right tilt that occurs when the third storage 200 is moved in the front-rear direction of the tub 130.

Specifically, if the left-right tilt of the third storage 200 occurs too much, the guide rib 230 may contact with the guide rail 1311 and limit the range of the left-right tilt occurring in the third storage 200, such that the collision of at least one of the first roller 210, the second roller 221 or the rail guide 222 against the packing 300 provided in a front area of the tub 130 may be prevented.

A single guide rib 230 or a plurality of guide ribs 230 may be provided. In one embodiment of the present disclosure, two guide ribs 230 may be provided in each lateral surface of the third storage 200 and total four guide ribs 230 may be provided. Even in case that one guide rib or three or more are provided in each lateral surface of the third storage 200, the guide rib may have a structure which will be described later or a similar structure.

At least predetermined area of the guide rib 230 may face the guide rail 1311. With such a structure, the guide rib 230 may contact with the facing surface of the guide rail 1311 to limit the left-right tilt of the third storage 200 if the third storage 200 is tilted in the left-right direction too much.

When four guide ribs 230 are provided, a pair of guide ribs may be provided in one lateral surface of the third storage 200. At this time, the pair of the guide ribs 230 may be spaced a preset distance from each other in the front-rear direction and the vertical direction of the storage.

It may be proper that at least predetermined area of each guide rib 230 may be overlapped with the guide rail 1311 in a guide rail facing direction.

One of the two guide ribs that is provided in a relatively upper area may contact with an upper area of the guide rail 1311 and the other one that is provided in a relatively lower area may contact with a lower area of the guide rail 1311.

As shown in FIG. 10, the pair of the guide ribs 230 may be protruded from the lateral surface of the third storage 200 and integrally formed with the third storage 200.

In addition, the guide ribs 230 may be formed in an area that is distant from the first roller 210, the second roller 221 and the rail guide 222 not to interfere with them.

Accordingly, one of the two guide ribs 230 may be arranged in front of the rail guide 222 and the other one may be arranged behind the first roller 210 and the second roller 221.

The guide rib 230 may be spaced apart from the mount bracket not to interfere with the mount bracket 240.

Accordingly, one of the guide brackets 230 may be provided in front of the mount bracket 240 and the other one may be provided behind the mount bracket 240, spaced apart from the mount bracket 240.

Figure 11:
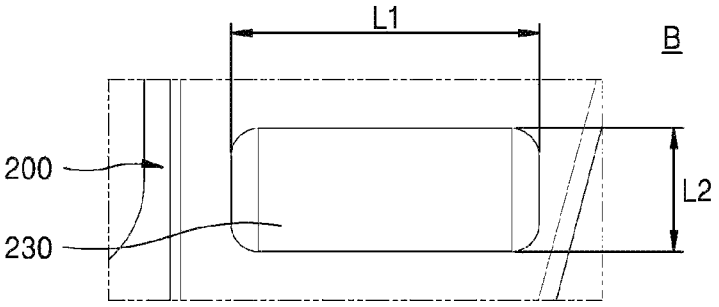
FIG. 11 is an enlarged view of B shown in FIG. 10.
Figure 12:
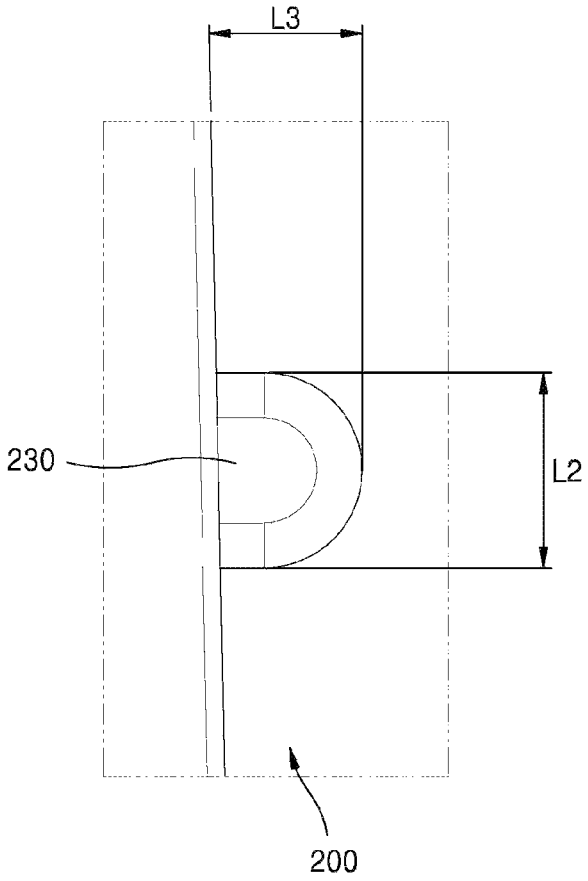
FIG. 12 is a side view of FIG. 11.
Figure 13:
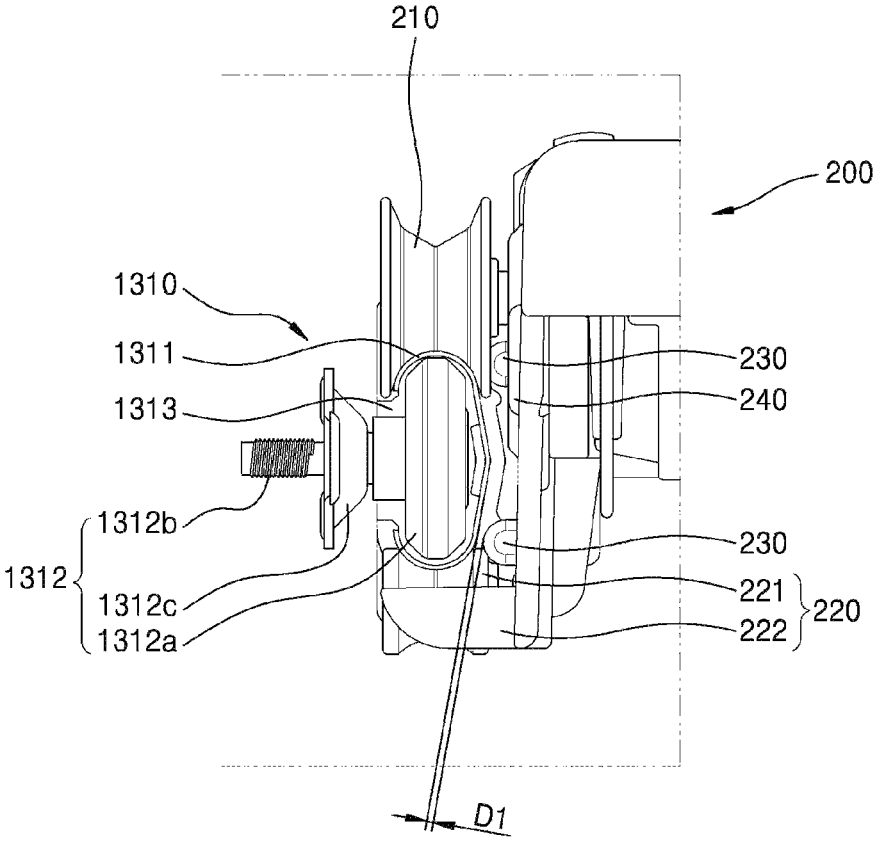
FIG. 13 is a diagram illustrating the other elements shown in FIG. 5 after removing some elements.

FIG. 11 is an enlarged view of B shown in FIG. 10. FIG. 12 is a side view of FIG. 11. FIG. 13 is a diagram illustrating the other elements shown in FIG. 5 after removing some elements.

The length L1 of the guide rib 230 in the front-rear direction of the third storage 200 may be larger than the length L2 of the guide rib 230 in the vertical direction of the third storage 200. In other words, the guide rib 230 may be longer than the length of the third storage 200.

Compared with a case that L2 is larger than L1, a total area where the guide rib 230 contacts with the guide rail 1311 when the third storage 200 is moved in the longitudinal direction of the tub 130 may be reduced. Accordingly, such the structure may reduce the noise generated by the contact between the guide rib 230 and the guide rail 1311 and the wear of the guide rail 1311.

In addition, the guide rib 230 may have a round end and a round corner. Referring to FIG. 12, an end of the guide rib 230, in other words, a cross section of an area facing the guide rail 1311 may be rounded like a semi-circular or half-ellipse shape.

Such the structure may minimize the contact area between the end of the guide rib 230 and the guide rail 1311. Accordingly, the noise generated by the contact between the guide rib 230 and the guide rail 1311 and the wear of the guide rib 230 may be reduced and the third storage 200 provided with the guide rib 230 may be movable in the front-rear direction of the tub 130 smoothly.

Referring to FIG. 11, the corner of the guide rib 230 may have a round shape having a sharp area removed there from. The collision of the sharp area against the guide rail 1311, when the third storage 200 is moved in the front-rear direction, may be prevented.

Accordingly, the noise and the wear of the guide rib 230 may be reduced. The third storage 200 provided with the guide rib 230 may be moved in the front-rear direction of the tub 130 smoothly.

The size of the guide rib 230 may be selected based on the sizes, structures and other factors of the third storage 200 and the guide rail 1311. For example, the length L1 of the guide rib 230 in the front-rear direction of the third storage 200 may be 13 mm to 16 mm in the third storage 200 and the guide rail 1311 having the structure shown in the drawings.

In addition, the length L2 of the guide rib 230 in the vertical direction of the third storage 200 may be 4 mm to 6 mm. The height of the guide rib 230 may be 4 mm to 6 mm.

At his time, the sizes of the two guide ribs 230 may be identical or different.

Referring to FIG. 13, the shortest distance D1 between the surface of the guide rail 1311 and the surface of the guide rib 230 may be properly selected based on a designed allowable scope of the left-right tilt of the third storage 200. According to the embodiment, D1 may be approximately 1 mm and 0.5 to 1.5 mm may be more proper.

In some implementations, the storage may have the first roller 210, the second roller 221 and the rail guide 222 that are provided in each lateral surface. Those elements may facilitate the smooth coupling of the storage to the guide rail 1311 provided in the tub 130 and the smooth moving of the storage in the front-rear direction of the tub 130 along the guide rail 1311.

In some implementations, the collision of the storage against the packing 300 may be suppressed by the guide rib 230 such that the damage of the packing caused by the collision with the storage and the error of the dishwasher 100 provided with the storage may be effectively suppressed.

The embodiments are described above with reference to a number of illustrative embodiments thereof. However, the present disclosure is not intended to limit the embodiments and drawings set forth herein, and numerous other modifications and embodiments can be devised by one skilled in the art. Further, the effects and predictable effects based on the configurations in the disclosure are to be included within the range of the disclosure though not explicitly described in the description of the embodiments.

Description of Numeral References

| | | |
|---|---|---|
| 100: Dishwasher | 120: Case | 122: Door |
| 123: Control panel | 124: Handle | 125: Mounting surface |
| 130: Tub | 132: Top spray portion | 133: Upper spray portion |
| 134: Lower spray portion | 1310: Guide mechanism | 140: Drive |
| 1311: Guide rail | 1312: Rail support | 200: Third storage |
| 1312a: First piece | 1312b: Second piece | 223: Mounting groove |
| 1312c: Third piece | 1313: Stopper | 251: Outer frame |
| 150: First storage | 160: Second storage | 300: Packing |
| 201: First mounting hole | 202: Second mounting hole | |
| 210: First roller | 220: Guide | |
| 221: Second roller | 222: Rail guide | |
| 230: Guide rib | 240: Mount bracket | |
| 241: First mounting portion | 242: Second mounting portion | |
| 243: Avoid groove | 244: Through-hole | |
| 252: Divide frame | 253: Storage portion | |

What is claimed is:

1. A dishwasher comprising:

a tub that defines a washing space configured to accommodate cooking vessels; and a storage disposed in an interior of the dishwasher and configured to support the cooking vessels, the storage comprising:

a first roller disposed at a lateral surface of the storage and configured to guide movement of the storage, a guide that is disposed at the lateral surface of the storage, that is disposed below the first roller, and that is configured to guide the movement of the storage, and a guide rib that is disposed at the lateral surface of the storage, that is disposed at a vertical level between a vertical level of an upper end of the first roller and a vertical level of a lower end of the guide, and that protrudes in a lateral direction of the storage, wherein the tub comprises a guide mechanism disposed at an inner lateral wall of the tub and configured to support the storage and to guide the movement of the storage relative to the tub, wherein the guide mechanism comprises a guide rail that extends in a front-rear direction of the tub, the guide rail being in contact with the first roller and the guide, wherein the guide rail has a facing surface that is configured to face at least a portion of the guide rib, and wherein the guide rib is configured to contact the facing surface of the guide rail to thereby limit a left-right tilt of the storage.

2. The dishwasher of claim 1, wherein the guide rail has an upper end in contact with the first roller and a lower end in contact with the guide, and wherein the storage is coupled to the guide rail.

3. The dishwasher of claim 2, wherein the guide mechanism further comprises a stopper that is coupled to an end of the guide rail and configured to limit a moving range of the storage in the front-rear direction.

4. The dishwasher of claim 3, wherein the stopper comprises a cover coupled to the end of the guide rail and configured to limit movement of the first roller in the front-rear direction.

5. The dishwasher of claim 2, wherein the guide comprises:

a second roller that supports the lower end of the guide rail; and a rail guide that is spaced apart from the second roller in the front-rear direction and protrudes in the lateral direction of the storage.

6. The dishwasher of claim 5, wherein the guide rib is one of a pair of guide ribs that are disposed at the lateral surface of the storage, the pair of guide ribs being spaced apart from each other in the front-rear direction and in a vertical direction of the storage.

7. The dishwasher of claim 6, wherein one of the pair of guide ribs is arranged forward relative to the first roller and the rail guide in the front-rear direction, and the other of the pair of guide ribs is arranged rearward relative to the first roller and the second roller.

8. The dishwasher of claim 6, further comprising a mount bracket coupled to the lateral surface of the storage, wherein the first roller and the second roller are coupled to the mount bracket.

9. The dishwasher of claim 8, wherein the lateral surface of the storage defines a first mounting hole and a second mounting hole that are spaced apart from each other and that receive portions of the mount bracket, and wherein the mount bracket comprises:

a first mounting portion that protrudes from a first side of the mount bracket and is inserted in the first mounting hole, a second mounting portion that protrudes from a second side of the mount bracket and is inserted in the second mounting hole, and an avoid groove that has a shape corresponding to the rail guide and is recessed from a surface of the mount bracket, the avoid groove receiving at least a portion of the rail guide.

10. The dishwasher of claim 8, wherein the rail guide is an integral part of the storage.

11. The dishwasher of claim 8, wherein one of the pair of guide ribs is disposed forward relative to the mount bracket and spaced apart from a front end of the mount bracket, and the other of the pair of guide ribs is disposed rearward relative to the mount bracket and spaced apart from a rear end of the mount bracket.

12. The dishwasher of claim 2, wherein the guide rail is one of a pair of guide rails that are coupled to a pair of lateral walls of the tub, respectively, the pair of lateral walls of the tub including the inner lateral wall of the tub.

13. The dishwasher of claim 1, wherein the guide rib has a round end and a round corner.

14. The dishwasher of claim 1, wherein a length of the guide rib in a front-rear direction of the storage is greater than a height of the guide rib in a vertical direction of the storage.

15. The dishwasher of claim 1, wherein the first roller is one of a pair of first rollers that are disposed at the lateral surface of the storage and spaced apart from each other in a front-rear direction of the storage.

16. The dishwasher of claim 1, wherein a shortest distance between the facing surface of the guide rail and the guide rib defines a limit of the left-right tilt of the storage.

17. A dishwasher comprising:

a tub configured to accommodate cooking vessels; and a storage disposed in the tub and configured to support the cooking vessels, the storage being configured to move relative to the tub and comprising:

a first roller disposed at a lateral surface of the storage and configured to guide movement of the storage relative to the tub, a guide that is disposed at the lateral surface of the storage, that is disposed below the first roller, and that is configured to guide the movement of the storage, and a guide rib that is disposed at the lateral surface of the storage, that is disposed at a vertical level between a vertical level of an upper end of the first roller and a vertical level of a lower end of the guide, and that protrudes in a lateral direction of the storage, wherein the dishwasher further comprises a guide rail that is coupled to the tub and extends a front-rear direction of the tub, the guide rail being in contact with the first roller and the guide, wherein the storage is coupled to the guide rail, wherein the guide rail has a facing surface that is configured to face at least a portion of the guide rib, and wherein the guide rib is configured to contact the facing surface of the guide rail to thereby limit a left-right tilt of the storage.

18. The dishwasher of claim 17, wherein the guide rail has an upper end in contact with the first roller and a lower end in contact with the guide.

19. The dishwasher of claim 17, wherein the guide rib has a round end and a round corner, and wherein a length of the guide rib in the front-rear direction of the tub is greater than a height of the guide rib in a vertical direction of the storage.

20. The dishwasher of claim 17, further comprising a rail supporter that is coupled to a lateral wall of the tub and supports the guide rail, wherein the rail supporter comprises:

a plurality of first pieces spaced apart from one another in the front-rear direction of the tub and coupled to the guide rail, a second piece having a first end coupled to the lateral wall of the tub and a second end coupled to one of the plurality of first pieces, and a third piece that extends in the front-rear direction of the tub and receive the second piece.

* * * * *